United States Patent [19]

Diener

[11] 4,187,264

[45] Feb. 5, 1980

[54] CARBURETOR FOR AN INTERNAL COMBUSTION ENGINE

[76] Inventor: Rudolf Diener, Seefeldstrasse 253, Zürich, Switzerland

[21] Appl. No.: 917,277

[22] Filed: Jun. 20, 1978

Related U.S. Application Data

[63] Continuation of Ser. No. 680,387, Apr. 26, 1976, abandoned.

[30] Foreign Application Priority Data

May 9, 1975 [CH] Switzerland ..... 6017/75
Jul. 28, 1975 [CH] Switzerland ..... 9835/75

[51] Int. Cl.[2] ..... F02M 29/02

[52] U.S. Cl. ..... 261/84; 239/222; 239/248; 239/249

[58] Field of Search ..... 261/88, 84; 239/222, 239/237, 248, 249, 228, 231

[56] References Cited

U.S. PATENT DOCUMENTS

| | | | |
|---|---|---|---|
| 1,662,602 | 3/1928 | Dunkelberg | 261/88 |
| 2,186,829 | 1/1940 | Haddock | 261/84 |
| 2,668,698 | 2/1954 | Rollins | 261/88 |
| 2,922,631 | 1/1960 | Koktan | 261/84 |
| 3,220,457 | 11/1965 | Bailey | 239/222 |
| 3,398,893 | 8/1968 | Missimer et al. | 239/222 |

FOREIGN PATENT DOCUMENTS

| | | | |
|---|---|---|---|
| 559856 | 1/1975 | Switzerland | 261/84 |
| 1144763 | 3/1969 | United Kingdom | 261/84 |

*Primary Examiner*—Tim R. Miles
*Attorney, Agent, or Firm*—O'Brien and Marks

[57] ABSTRACT

A carburetor for an internal combustion engine comprising a fuel chamber arranged in the mixing compartment of a suction tube and rotatable about the lower end of a fuel-infeed conduit secured in the mixing compartment by means of an impeller wheel rotatable in the sucked-up air current. The fuel chamber possesses at least one lateral nozzle for the delivery of fuel into the mixing compartment. A ring-shaped gap is provided in the fuel chamber between its inner wall and the stationary fuel-infeed conduit. By means of this gap a lower fuel compartment, into which opens the fuel-infeed conduit, communicates with an upper fuel compartment. The upper fuel compartment has a ring-shaped air inlet opening which is coaxially arranged with respect to the fuel-infeed conduit.

22 Claims, 12 Drawing Figures

CARBURETOR FOR AN INTERNAL COMBUSTION ENGINE

CROSS REFERENCE TO RELATED APPLICATIONS

This is a Continuation application filed under 37 CFR 1.60 from its pending parent application Ser. No. 680,387 filed Apr. 26, 1976, now abandoned.

BACKGROUND OF THE INVENTION

The present invention relates to a new and improved construction of carburetor for an internal combustion engine which is of the type comprising a fuel chamber arranged in the mixing compartment of a suction tube and rotatable, by means of an impeller wheel rotating in the suck-up air current, about the lower end of a fuel-infeed conduit secured in the mixing compartment, and wherein the fuel chamber possesses at least one lateral nozzle for delivering fuel to the mixing compartment.

Such type of carburetor as described for instance in Swiss Pat. No. 559,856 provides such a good prepared and properly dosed fuel-air mixture for all operating conditions of the combustion engine that the quantity of noxious substances, such as CO and CH, contained in the exhaust gases is considerably below the permissible threshold value. Exact measurements undertaken at different models with respect to the proportion of CO and CH, the engine efficiency and the fuel consumption and extensive checking of the manner of driving a vehicle equipped with such carburetor have shown that flaws still exist. Typical of these are unsatisfactory idling, smaller CO-peaks at low or intermediate rotational speeds, too little CO in the full load range where usually it is considered advantageous to have a CO-content even if of small magnitude, and so forth.

SUMMARY OF THE INVENTION

It is a primary object of the present invention to provide an improved carburetor of the previously mentioned type wherein such flaws and attendant phenomenon are at least extensively eliminated.

Another object of the present invention is to provide such type carburetor which, with relatively simple construction allowing for rational production, also satisfies extreme performance demands.

Now in order to implement these and still further objects of the invention, which will become more readily apparent as the description proceeds, the carburetor of this development is manifested by the features that a substantially ring-shaped or annular gap is provided in the fuel chamber between its inner wall and the stationary fuel-infeed conduit. By means of this ring-shaped gap a lower fuel compartment, into which opens the fuel-infeed conduit, flow communicates with an upper fuel compartment. The upper fuel compartment is equipped with a ring-shaped air inlet opening coaxially arranged with respect to the fuel-infeed conduit.

The advantage over heretofore known constructions resides in the fact that no seal is necessary between the stationary fuel-infeed conduit and the rotating fuel chamber, through which additional fuel can arrive at the mixing compartment, since by means of the ring-shaped gap there is limited the delivery of fuel from the lower fuel compartment to the upper fuel compartment.

A preferred construction of carburetor is manifested by the features that there is provided within the fuel chamber housing a ring-shaped compartment between a housing wall and the fuel-infeed conduit, this ring-shaped compartment surrounding the ring-shaped gap and the upper fuel compartment. The length of such ring-shaped compartment is greater than the outer diameter of the fuel-infeed conduit. The diameter of the lower fuel compartment coaxial with the fuel infeed compartment is smaller than the external diameter of the fuel infeed conduit. Leading laterally upwardly away from the lower fuel compartment is at least one fuel channel provided at its upper end with a nozzle which is a dosing nozzle delivering a quantity of fuel which is at least approximately proportional to the square root of the fuel excess pressure in the fuel channel.

The diameter of the lower fuel compartment is preferably equal to the internal diameter of the fuel-infeed conduit. The fuel channel can possess an intermediate section which is parallel to the rotational axis of the fuel compartment and the diameter of which is not greater than the diameter of the lower fuel compartment and greater than the nozzle diameter. The starting section extending from the intermediate section of the fuel channel to the lower fuel compartment and the terminal or end section thereof extending from the intermediate section to the nozzle can each be located in a plane perpendicular to the rotational axis of the fuel compartment and preferably radially directed. In this respect it is particularly advantageous if the starting section, the intermediate section and the terminal section of the fuel channel have the same diameter and such diameter is equal to or at most up to 10 percent less than the diameter of the lower fuel compartment. In order to have a post-atomization of the fuel ejected from the nozzle it is possible to arrange in front of the nozzle an atomizer device, particularly in the form of a spray edge. Such is especially then advantageous in those cases where the diameter of the nozzle needed for the delivery of the required quantity of fuel is too large to achieve a proper atomization of the fuel. Generally by providing a single nozzle there can be realized optimum preparation of the fuel-air mixture. If, for instance, there are required for this purpose two nozzles then such are advantageously arranged at the fuel chamber housing at different elevational positions and with an angular spacing of less than or equal to 180°.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Describing now the drawings, firstly it is to be understood that the fuel-infeed conduit with the coaxial fuel chamber rotating thereabout and the impeller wheel are arranged in the suction conduit of the engine between the air filter and the control valve or flap.

Figure 1:
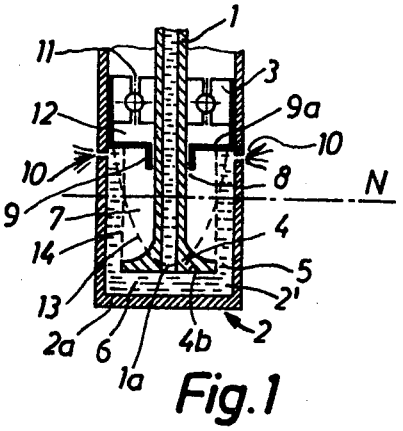
FIG. 1 is a schematic illustration in longitudinal section of a fuel chamber rotatable about a fuel-infeed conduit and having nozzles arranged in the upper fuel compartment, and wherein the impeller wheel has been omitted to simplify the showing.

With the embodiment illustrated in FIG. 1 the fuel chamber is contained in a substantially cylindrical container or housing 2 having the floor or bottom 2*a* and which is rotatably mounted at the upper open end by means of a ball bearing 3 at the fuel-infeed conduit or pipe 1. The fuel-infeed conduit 1 is widened at its outlet opening 1*a* into a piston-shaped enlarged portion 4 which extends close to the inner wall of the fuel chamber housing 2 in order to form a substantially ring-shaped or annular gap 5 between the fuel-infeed conduit 1 and the fuel chamber, generally indicated by reference character 2'. The end surface 4*b* of the piston-shaped enlarged portion 4 has a certain spacing from the chamber floor 2*a*, so that between both of these components there is present a compartment which hereinafter will be referred to as the lower fuel compartment 6.

The fuel chamber housing 2 contains an insert member 9 having a transverse wall 9*a* between the ball bearing 3 and the piston-shaped enlarged portion 4 which surrounds the fuel-infeed conduit 1 while forming a ring-shaped or annular air inlet opening 8. Between the transverse wall 9*a* and the piston-shaped enlarged portion 4 there is thus provided in the fuel chamber 2' a further compartment which will be referred to hereinafter as the upper fuel compartment 7. This upper fuel compartment 7 thus is in communication via the ring-shaped gap 5 with the lower fuel compartment 6 and via the ring-shaped air inlet opening 8 and the opening 11 of the ball bearing 3 with the mixing compartment. The transverse wall 9*a* is adequately spaced from the ball bearing 3 and between both of these components there is present an aeration compartment 12. No seal is provided between the fuel-infeed conduit 1 and the fuel chamber housing 2, so that for the rotation of the fuel chamber there is exclusively decisive the friction of the ball bearing. Immediately below the transverse wall 9*a* there are provided in the fuel chamber housing 2 a number of fuel outlet openings which with the embodiment of FIG. 1 are constituted by radial nozzles 10 having an opening diameter in the order of tenths of a millimeter. What is important for the proper operation is that the inner diameter of the ring-shaped gap 5 is greater than the outer diameter of the ring-shaped air inlet opening 8.

It is assumed that the fuel level N lies in the upper compartment 7 of the fuel chamber housing 2. When the fuel chamber housing 2 begins to rotate then the fuel ascends along the chamber wall and the fuel surface assumes the configuration of a paraboloid of revolution, generally indicated by reference character 13. At high rotational speeds there is formed in the upper fuel chamber 7 a fuel layer 14 bearing against the inner wall of the chamber, the thickness of which is determined by the width of the ring-shaped gap 5 and the lower fuel compartment 6 continually remains filled with fuel. The fuel level N must be at least such that the lower end of the fuel-infeed conduit 1 immerses into the fuel. The supply of fuel into the mixing compartment occurs in a dosed fashion through the nozzles 10 as a function of the rotational speed of the fuel chamber housing 2. It should be readily apparent that with this embodiment the insert member 9 also can be omitted if the diameter of the piston-shaped enlarged portion 4 can be made larger than the diameter of the ball bearing gap 11, in which case then such ball bearing gap 11 constitutes the ring-shaped air inlet opening.

Figure 2:
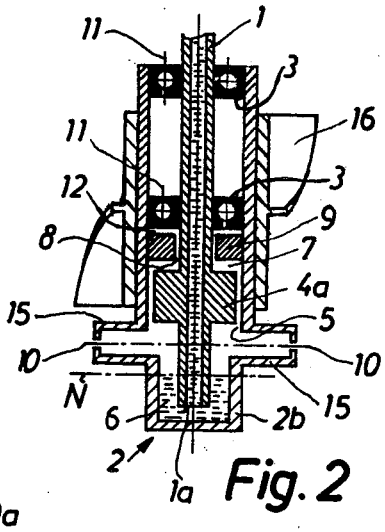
FIG. 2 is a longitudinal sectional view of a fuel chamber with impeller wheel and nozzles arranged in the lower fuel compartment.

With the embodiment illustrated in FIG. 2 the nozzles 10 are arranged in the lower fuel compartment 6 of the fuel chamber housing 2 carrying the impeller wheel 16 or the like. The fuel chamber housing 2 comprises at its lower end a cylindrical container 2*b*, the inner diameter of which need not be appreciably larger than the outer diameter of the therein protruding fuel-infeed conduit 1. Mounted at the container 2*b* are laterally extending tubes 15 containing at their front ends the nozzles 10. The piston-shaped enlarged portion 4*a* of the fuel-infeed conduit 1 is located above the small tubes or pipes 15. The ring-shaped gap 5 between the enlarged portion 4*a* and the fuel chamber-inner wall can be of extremely small width. Also the upper fuel compartment 7 located between the enlarged portion 4*a* and the insert 9 for forming the ring-shaped air inlet opening 8 can possess a very small volume.

Just as was the case for the embodiment of FIG. 1, here also the upper fuel compartment 7 is in communication with the mixing compartment or chamber via the air inlet opening 8, the aeration compartment 12 and the gaps 11 in the ball bearings 3. This embodiment is especially suitable for compact or small carburetor constructions. In this case the fuel level N is located in the lower fuel compartment 6 between the nozzles 10 and the outlet opening 1*a* of the fuel-infeed conduit 1. With the fuel chamber housing 2 rapidly rotating there is formed by the fuel compartment 7 a layer bearing against the wall, and the thickness of which layer is governed by the width of the ring-shaped gap 5. The delivery of fuel into the mixing compartment again occurs in a dosed fashion through the nozzles 10 as a function of the rotational speed of the fuel chamber housing 2.

Figure 3:
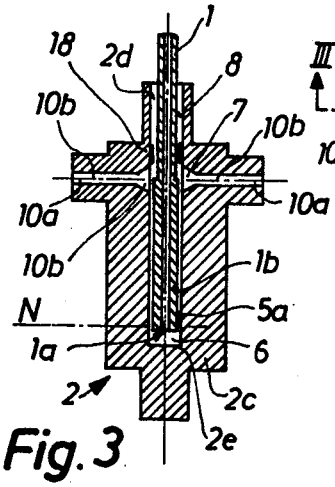
FIG. 3 is a longitudinal sectional view along the line III—III of FIG. 3*a* of a fuel chamber wherein the ring-shaped gap between the upper and lower fuel compartments serves for fuel dosing.
Figure 3A:
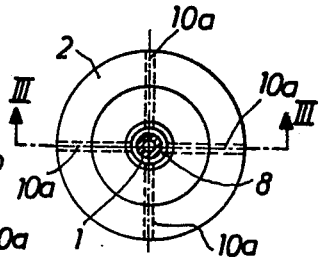
FIG. 3*a* is a top plan view of the fuel chamber of FIG. 3.

With the embodiment shown in section in FIG. 3 and in plan view in FIG. 3*a* the fuel chamber housing 2 comprises a metallic body or body member 2*c* having a relatively long central bore 2*d*. The fuel-infeed conduit 1 extends almost up to the bore base or floor 2*e*, so that between these two components there is present a small lower fuel compartment 6. At a relatively large spacing from the bore base 2*e* the metallic body 2*c* possesses, for instance, four continuous bores 10*b*, the outer openings of which constitute the fuel outlet openings 10*a* of the fuel chamber 2. At the inner end the bores 10*b* are for instance conically widened, the conical widened portions forming the upper fuel compartment 7 of the fuel chamber. The fuel-infeed conduit 1 from the region of its outlet opening 1*a* up to approximately the center of the radial bores 10*b* possesses a diameter which is only slightly less than the inner chamber diameter. Hence, the ring-shaped gap 5*a* between the lower fuel compartment 6 and the upper fuel compartment 7 has a length amounting to a multiple of its diameter, and the width of the ring-shaped gap 5*a* is smaller than the diameter of the outlet opening 1*a* of the fuel-infeed conduit 1. Above the section 1*b* extending up to the radial bores 10*b* the fuel-infeed conduit 1 has a somewhat smaller diameter, so that the ring-shaped air inlet opening 8 between such tubular portion and the chamber wall is wider than the ring-shaped gap 5*a*. There can be inserted into the air inlet opening 8 a socket or sleeve 18 in order to obtain a ring-shaped inlet opening, the diameter of which, as previously described, is smaller than that of the ring-shaped gap 5*a*.

The fuel level should be located slightly above the opening 1*a* of the fuel-infeed conduit 1. When the fuel chamber rotates the fuel ascends out of the lower fuel compartment 6 through the ring-shaped gap 5*a* into the upper fuel compartment 7 and at this location is withdrawn outwardly by the centrifugal force to the fuel outlet openings 10*a* through the bores 10*b* and atomized at the outlet openings 10*a*. Moreover, air is sucked-up through the air inlet opening 8 so that there is already delivered by the outlet opening 10*a* a fuel-air mixture into the mixing compartment. It is has been found that such is very advantageous for the preparation of the mixture. Decisive for the fuel dosage are the length and width of the ring-shaped gap 5*a*. Hence, the fuel level N should be held as constant as possible.

Figure 4:
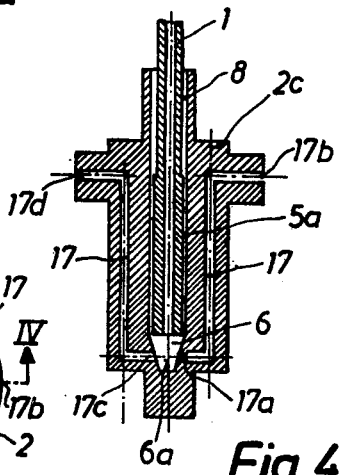
FIG. 4 is a longitudinal sectional view of a fuel chamber similar to that of FIG. 3, however, having additional fuel channels for idling.
Figure 4A:
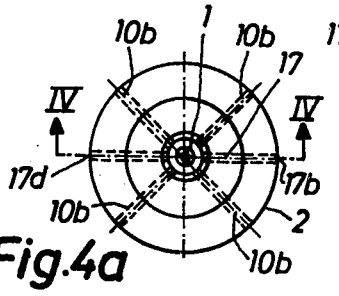
FIG. 4*a* is a plan view of the fuel chamber of FIG. 4.

It can happen that with particularly low values of the content of CO- and CH-noxious substances the obtained mixture is too lean for engine idling. This can be particularly the case with the embodiment of FIG. 3 since here the fuel dosage does not occur proportional to the rotational speed, rather more as a function of the square thereof. FIGS. 4 and 4*a* respectively shown in section and plan view an embodiment which overcomes this defect. The fuel-infeed conduit 1 and the fuel chamber housing 2 with the bores 10*b* (FIG. 4*a*) radially leading away from the upper fuel compartment and the long and narrow ring-shaped gap 5*a* are in this case constructed like the embodiment of FIG. 3. The lower fuel compartment 6 (FIG. 4) is downwardly extended by a for instance conical recess or depression 6*a*. Leading from this recess or depression 6*a* are for instance two diametrically opposed channels 17 through the metallic body 2*c* of the fuel chamber to the delivery or outlet openings 17*b*, 17*d*, which, with the illustrated fuel chamber, are located at the same height as the fuel outlet openings 10*a*. With low rotational speed fuel also reaches the recess or depression 6*a* of the lower fuel compartment 6 and from that location flows through the channels 17 to the delivery or outlet openings 17*b*, 17*d* where it is atomized. In order to dose the additional fuel delivery the channel opening located in the coaxial recess 6*a* or the delivery opening can be constructed as a nozzle with a narrower cross-section, as illustrated at 17*a* and 17*d*. The delivery openings 17*b*, 17*d* can also be arranged lower than the fuel outlet openings 10*a*. Of course for the enrichment of the fuel during idling there can be provided other measures, such as for instance an increased rotational speed of the impeller wheel in the idling range of the engine, which for instance is realized by a weak eddy current brake, wherein the impeller wheel is more intensely braked at higher rotational speeds than at lower rotational speeds.

Figure 5:
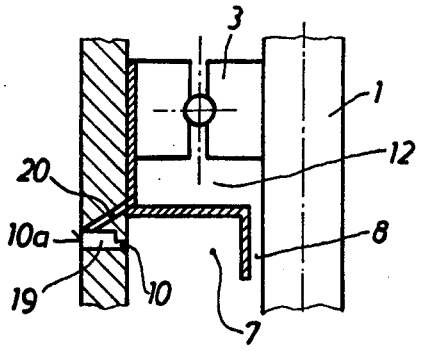
FIG. 5 is an enlarged fragmentary sectional view of the region of a fuel chamber encompassing a nozzle and constituting a variant construction from that of FIG. 1.

As mentioned with the chamber construction of FIG. 3 the air infeed to the fuel which occurs prior to atomization is particularly advantageous. This can also be provided with other constructions of fuel chambers. Thus, in FIG. 5 there is shown on an enlarged scale a fragmentary section of the fuel chamber of FIG. 1 containing the nozzle 10 and where certain modifications will be apparent. Between the ball bearing 3 and the insert member 9 there is located the aeration compartment 12 and below the insert member 9 the upper fuel compartment 7. The nozzle 10 leads to an enlarged bore 19 in the chamber wall and this bore 19 is connected by means of an air channel 20 with the aeration compartment 12. With rotating fuel compartment the fuel is dispensed out of the nozzle 10 and air out of the air channel 20 into the enlarged bore 19 and at the opening of the last-mentioned bore, which corresponds to the fuel outlet opening 10*a* of FIG. 3, there occurs a further atomization of the fuel pre-atomized by the nozzle and specifically in the presence of air.

Figure 6:
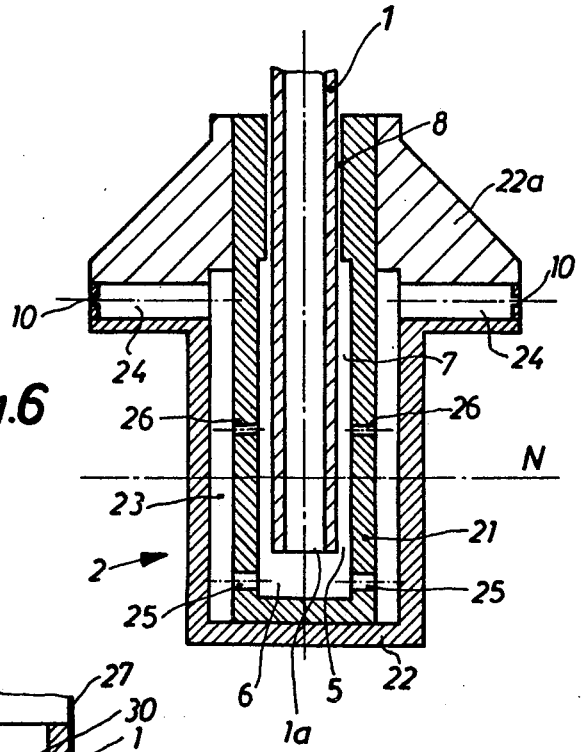
FIG. 6 is a longitudinal sectional view of a further embodiment of a fuel chamber.

With the embodiment shown in longitudinal sectional view in FIG. 6 the fuel chamber 2 consists of an inner fuel chamber 21 and an outer fuel chamber 22. The inner fuel chamber 21 is essentially constructed as previously described and contains the lower fuel compartment 6 into which opens the fuel-infeed conduit 1, the ring-shaped gap 5, the upper fuel compartment 7 and the ring-shaped air inlet opening 8. With the illustrated embodiment the fuel-infeed conduit 1 is smooth and does not possess any enlarged portion. The upper fuel compartment 7 is in the form of a cylindrical hollow compartment or space having the cross-section of the ring-shaped gap 5. The outer fuel chamber 22 surrounding the inner fuel chamber 21 forms together therewith a cylindrical hollow space or compartment 23 which communicates via lateral bores 25 in the inner fuel chamber 21 with the lower fuel compartment 6 and thus forms a second "lower fuel compartment" of the fuel chamber 2. The outer diameter of this second lower fuel compartment 23 is greater than the diameter of the first lower fuel compartment in the inner fuel chamber 21. The head portion 22*a* of the outer fuel chamber 22 contains, for instance, four radial bores 24 by means of which the second lower fuel compartment 23 is connected with the nozzles 10. The fuel level N is located between the outlet opening 1*a* of the fuel-infeed conduit 1 and the nozzles 10. Above the fuel level N it is possible for channels 26 to lead from the upper fuel compartment 7 of the inner fuel chamber 21 to the fuel compartment 23 of the outer fuel chamber 22.

When the fuel chamber 2 begins to rotate then the fuel in the second lower fuel compartment 23, due to its greater diameter, climbs quicker than in the first lower fuel compartment 6 and by means of the lateral bores 25 in the inner fuel compartment 21 there is realized a pump effect so that fuel is withdrawn out of the fuel compartment 6 into the fuel compartment 23. Equally, fuel can flow through the channels 26 provided as an aid into the fuel compartment 23. It has been found that such a construction of the fuel chamber—which is advantageous in terms of manufacture—is insensitive to fluctuations of the fuel level and that also no fuel penetrates through the air inlet opening 8.

Figure 7:
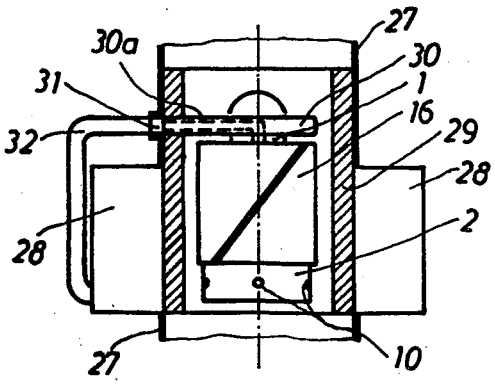
FIG. 7 is a schematic illustration of a carburetor arrangement according to the invention.

In FIG. 7 there is schematically illustrated a preferred embodiment of the entire carburetor arrangement. A tubular stud or connection 27, forming a part of the suction conduit of the engine, carries a housing block 28 with the fuel supply for the carburetor. In order to maintain the level of the fuel there can be provided a float mechanism which, if necessary can be constructed such that the fuel level in the fuel chamber only slightly varies throughout the entire inclination range of the vehicle which arises in practice. A bushing or sleeve 29 which fits into the tubular stud or connection 27 carries at for instance three radial struts 30 the fuel infeed conduit 1 which is coaxial to the bushing and downwardly directed. The fuel-infeed conduit 1 is equipped with the fuel chamber 2 and the impeller wheel 16. In the simplest case a strut or web 30*a* is a tubular element, the inner end of which is connected with the fuel-infeed conduit 1 and at its outer end there is connected by means of a screw connection 31 a fuel line 32 leading to the fuel supply in the housing block 28. Such construction of the carburetor arrangement allows for a simple accommodation to different engine models, it only being necessary to differently dimension the bushing or sleeve 29.

The previously described exemplary embodiments of carburetors, as has been found, can be sensitive to greater fluctuations of the fuel level. The following described embodiments are insensitive to such level fluctuations.

Figure 8:
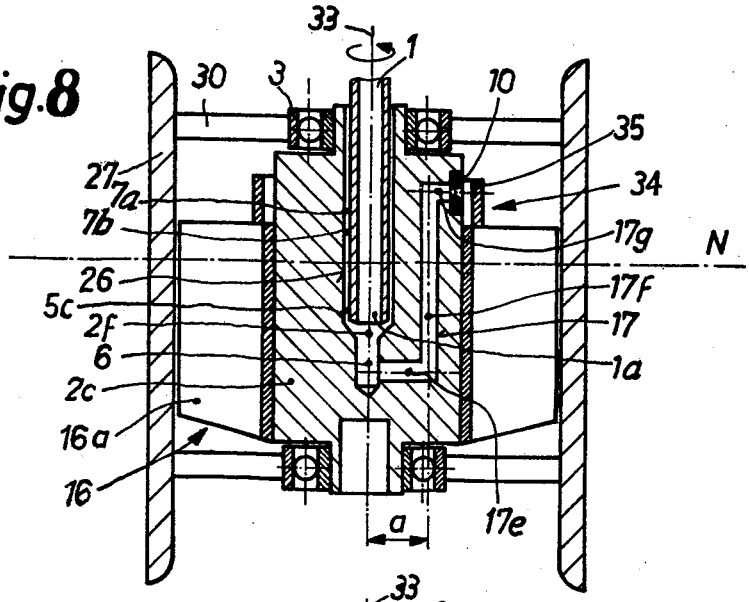
FIG. 8 is a longitudinal sectional view through a fuel chamber housing with a nozzle.

With the embodiment of FIG. 8 a cylindrical fuel chamber-housing block 2*c*, for instance formed of aluminum, contains an axial blindhole bore 2*f* extending from the top towards the bottom and stepped once in diameter. The lower portion of such bore which possesses the smaller diameter forms the lower fuel compartment 6 and the upper portion serves for receiving the fuel-infeed conduit 1 and has a diameter which is not much greater than the outer diameter of the fuel-infeed conduit 1. Hence, between the fuel-infeed conduit 1 and the bore wall 2*g* there is present a ring-shaped compartment 7*b* which encompasses the ring-shaped gap 5*c* and the upper fuel compartment 7*a* and has, for instance, a width of approximately 0.1 millimeter. Pushed onto the fuel chamber-housing block 2*c* is a plastic impeller wheel 16 and the entire assembly is supported in ball bearings 3 for rotation about the fuel-infeed conduit 1 and mounted by means of radial struts or webs 30 in a tubular stud or connection 27 or equivalent structure which is inserted in the mixing compartment in the suction conduit of the combustion engine. The upper part of the bore 2*f* intended to receive the lower end of the fuel-infeed conduit 1 has a depth which is a multiple of the outer diameter of the fuel-infeed conduit 1. The lower part or portion of the bore 2*f* forming the lower fuel compartment 6 has a diameter which is equal to the inner diameter of the fuel-infeed conduit. Internally of the housing block 2*c* a fuel channel 17 leads from the lower fuel compartment 6 to a nozzle 10 located in the housing block above the vanes 16*a* of the impeller wheel 16. The fuel channel 17 has three sections or portions, namely: a starting section 17*e* leading radially away from the lower fuel compartment 6, an intermediate section 17*f* which is parallel to the axis of rotation 33 of the housing block 2*c*, and an end or terminal section 17*g* which is radially closed by the nozzle 10. The individual channel sections 17*e*, 17*f*, 17*g* are constituted by bores in the housing block 2*c*. The nozzle 10 is a dosing nozzle which preferably has the shape of a standard nozzle and the diameter of which governs the delivered quantity of fuel.

The end section 17*g* of the fuel channel 17 is dimensioned such that the quantity of fuel delivered by the nozzle 10 is at least approximately proportional to the square root of the fuel excess pressure in the fuel channel. The intermediate section 17*f* of the fuel channel 17 has a diameter which is not greater than the diameter of the lower fuel compartment 6 and greater than the nozzle diameter. The diameter of the radial starting section 17*e* of the fuel channel 17 is not smaller than the diameter of the intermediate section 17*f* of the fuel channel. The starting section 17*e*, the intermediate section 17*f* and the end or terminal section 17*g* of the fuel channel 17 can have the same diameter as the lower fuel compartment 6 or their diameter is, for instance, up to 10 percent smaller than the diameter of the fuel compartment. According to one carburetor model the different diameters had, by way of example and not limitation, the following values: Inner diameter of the fuel-infeed conduit 1=diameter of the lower fuel compartment 6=diameter of the starting section 17*e* of the fuel channel 17=diameter of the intermediate section 17*f* thereof=diameter of the end section 17*g* of the fuel channel=1.6 millimeters; diameter of the nozzle 10=0.5 millimeters.

For the post-atomization of the fuel-spray jet emanating from the nozzle 10 the housing block 2*c* carries an atomizer device 34, preferably in the form of a spray edge. With the embodiment of FIG. 8 the atomizer device 34 consists of a ring 35 formed for instance of one-piece with the impeller wheel 16 and which surrounds at a certain spacing the housing block 2*c*. The ring spacing and the ring height over the nozzle axis govern the degree of atomization. The fuel level N is adjusted between the outlet opening 1*a* of the fuel-infeed conduit 1 and the nozzle 10.

When the housing block 2*c* is placed into rotation by the impeller wheel 16 then fuel ascends in the fuel channel 17 to the nozzle 10 and is dosed by the latter and atomized as fine droplets through the atomization device 34 and delivered into the mixing compartment. In this connection the following relationships are present: (a) the rotational speed of the lower fuel compartment 6, the fuel channel 17 and the nozzle 10 are approximately proportional to the quantity of air sucked-up per unit of time; (b) the fuel excess pressure in front of the nozzle 10 owing to the centrifugal force is approximately proportional to the square of the rotational speed, and (c) the quantity of fuel delivered by the nozzle 10 per unit of time is approximately proportional to the square root of the rotational speed, so that the fuel quantity delivered per unit of time is always proportional to the quantity of air sucked-up per unit of time.

Notwithstanding the very simple construction and the relatively small size—FIG. 8 is an enlarged view—the results which can be obtained with such a carburetor are surprisingly good. It has been found that the increase of the CO-content desired with full load is present with increasingly greater rotational speeds, the greater the spacing a of the axially parallel intermediate section 17*f* of the fuel channel 17 from the rotational axis 33, so that such CO-increase can be realized without difficulty at a predetermined desired rotational speed.

Figure 9:
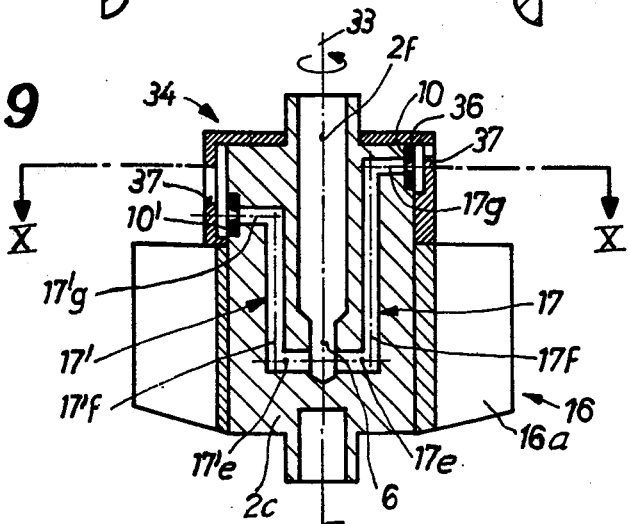
FIG. 9 is a longitudinal sectional view through a fuel chamber housing having two diametrically opposite nozzles.

FIG. 9 illustrates a variant of the carburetor arrangement wherein the fuel chamber-housing block 2c is equipped with two diametrically opposite nozzles 10, 10'. Leading from the lower fuel compartment 6 to each nozzle 10 and 10' is a respective fuel chamber 17 and 17', which can be constructed like the fuel channel of the embodiment of FIG. 8, i.e. both of the fuel channels 17 and 17' each consist of a radial starting section 17e and 17'e respectively, an axially parallel intermediate section 17f and 17'f respectively, and a radial end section 17g and 17'g. As concerns the two nozzles the one nozzle 10' is closer to the impeller wheel 16 than the other nozzle 10. In this case the atomizer or atomization device 34 provided for the post-atomization of the fuel delivered by the nozzles 10, 10' consists of a cap member 36 placed upon the housing block 2c and which extends to a point below the nozzle 10' and at the region of the nozzles 10, 10' possesses a respective section for forming a spray or spraying edge 37.

Figure 10:
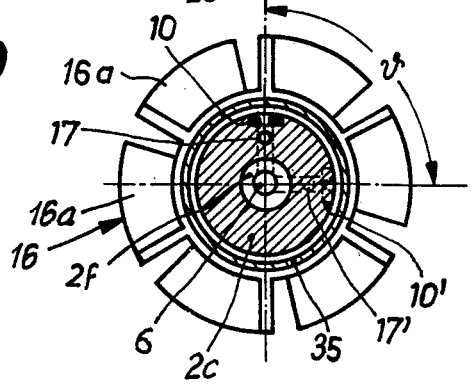
FIG. 10 is a cross-sectional view through a fuel chamber housing having two nozzles, the angular spacing of which is less than 180°.

FIG. 10 illustrates a section through the carburetor of FIG. 9 along the line III—III, wherein however the two nozzles 10, 10' are not situated diametrically opposite one another as in FIG. 9 rather at an angular spacing $\theta$ of less than 180°, for instance 90°. In FIG. 10 reference character 10 designates the upper nozzle and reference character 10' the lower nozzle. The cylindrical housing block 2c contains the lower fuel compartment 6 from which the fuel channels 17, 17' lead to the nozzles 10, 10'. The housing block 2c carries the impeller wheel 16 with the vanes 16a and the ring-shaped attachment or extension 35 serving for the post-atomization of the delivered fuel.

It should be readily apparent that the previously described carburetors, with essentially the same basic construction, can be readily accommodated to the most different engine models by the number of nozzles, construction of the fuel channels and the dimensions. In particular the post-atomization with an atomizer device can also be omitted if with higher rotational speeds and smaller nozzle diameter there is realized a satisfactory atomization of the fuel. In order to obtain a small constructional height or length of the carburetor, it is advantageous to arrange the impeller wheel 16 at the housing block 2c below the nozzle(s). The impeller wheel can be however also arranged above the nozzles.

It has been found that also with the lowest content of noxious substances in the exhaust gases there can be obtained an increased efficiency of the engine. This means that optimization is possible for the content of noxious substances and engine efficiency, so that subsequent modifications, as such are oftentimes carried out to increase the engine efficiency at the expense of less content of noxious substances, are no longer of interest and can be dispensed with. The carburetor also does not contain any adjustable adjustment means, so that there is also dispensed with a frequent post-adjustment of the carburetor. A notable advantage of the previously described carburetor constructions further resides in the fact that there is not required any accelerator or booster pump.

While there are shown and described present preferred embodiments of the invention, it is to be distinctly understood that the invention is not limited thereto, but may be otherwise variously embodied and practiced within the scope of the following claims.

Accordingly, what is claimed is:

1. A carburetor for an internal combustion engine, comprising means defining a fuel chamber, a fuel-infeed conduit cooperating with the fuel chamber, an impeller wheel for rotating the fuel chamber about a lower end of the fuel-infeed conduit, the fuel chamber possessing at least one lateral nozzle for the delivery of fuel into a mixing compartment, a substantially ring-shaped gap provided in the fuel chamber between its inner wall and the fuel-infeed conduit, the fuel chamber including a lower fuel compartment and an upper fuel compartment, said nozzle being disposed in the upper fuel compartment, the fuel-infeed conduit opening into the lower fuel compartment, the ring-shaped gap flow communicating the lower fuel compartment with the upper fuel compartment, the upper fuel compartment having a ring-shaped air inlet opening which is substantially coaxially arranged with respect to the fuel-infeed conduit, wherein the fuel-infeed conduit has an outlet opening, the ring-shaped gap between the lower fuel compartment and the upper fuel compartment possesses a length amounting to a multiple of its diameters and a gap width which is smaller than the diameter of the outlet opening of the fuel-infeed conduit, and wherein from the upper fuel compartment there leads a respective substantially radial bore to each said lateral fuel-delivery nozzle, and the diameter of the bore is greater than the width of the ring-shaped gap.

2. The carburetor as defined in claim 1, wherein the lower fuel compartment possesses a recess which is substantially coaxially arranged with respect to the fuel-infeed conduit, and at least one channel leading to means defining a fuel-delivery opening.

3. The carburetor as defined in claim 2, wherein the channel located in the coaxial recess of the lower fuel compartment has an opening which is different in size than said fuel-delivery opening of the channel.

4. The carburetor as defined in claim 3, wherein said channel opening is smaller than the fuel-delivery opening.

5. The carburetor as defined in claim 3, wherein said channel opening is larger than the fuel-delivery opening.

6. In a carburetor of the injection type for an internal combustion engine having a fuel supply and a mixing chamber, the combination comprising a fuel-infeed conduit adapted to be fixedly disposed coaxially within the mixing chamber, said conduit having a lower end with a fuel outlet opening, a fuel chamber cooperating with said conduit, an impeller for rotating the fuel chamber about the lower end of said conduit and about an axis defined by said conduit, said fuel chamber including a bottom disposed under the fuel outlet opening of said conduit and at least one fuel ejection opening being disposed above the fuel outlet opening of said conduit by a distance greater than an outer diameter of said conduit, said fuel chamber and the lower end of said conduit cooperating to define a lower fuel compartment, said lower fuel compartment extending between the fuel chamber bottom and the fuel outlet opening of said conduit, fuel flow channel means extending parallel to the axis of rotation of said fuel chamber from said lower fuel compartment to said fuel ejection opening, said channel means having a lower end communicating with said lower fuel compartment and an upper end transverse to the axis of rotation of said fuel chamber and communicating with said fuel ejection means, and an annular gap between said conduit and an inner surface of said fuel chamber.

7. The carburetor as defined in claim 6, wherein said fuel ejection opening has a diameter which is smaller than the diameter of said fuel chamber bottom.

8. A carburetor for an internal combustion engine, comprising means defining a fuel chamber, a fuel-infeed conduit cooperating with the fuel chamber, an impeller wheel for rotating the fuel chamber about a lower end of the fuel-infeed conduit, the fuel chamber possessing at least one lateral nozzle for the delivery of fuel into a mixing compartment, a substantially ring-shaped gap provided in the fuel chamber between its inner wall and the fuel-infeed conduit, the fuel chamber including a lower fuel compartment and an upper fuel compartment, the fuel-infeed conduit opening into the lower fuel compartment, the ring-shaped gap flow communicating the lower fuel compartment with the upper fuel compartment, the upper fuel compartment having a ring-shaped air inlet opening which is substantially coaxially arranged with respect to the fuel-infeed conduit, wherein the means defining said fuel chamber incorporates a housing having a housing wall, and within the fuel chamber-housing there is provided between the housing wall and the fuel-infeed conduit a substantially ring-shaped compartment forming the ring-shaped gap and the upper fuel compartment, the length of the ring-shaped compartment being greater than the outer diameter of the fuel-infeed conduit, and the diameter of the lower fuel compartment which is coaxial with the fuel-infeed conduit is smaller than the external diameter of the fuel-infeed conduit, and at least one fuel channel provided at its upper end with said nozzle, said channel leading laterally upwardly away from the lower fuel compartment, the nozzle comprising a dosing nozzle delivering a quantity of fuel which is at least approximately proportional to the square root of the fuel excess pressure prevailing in the fuel channel.

9. The carburetor as defined in claim 8, wherein the lower fuel compartment has a diameter which is substantially equal to the inner diameter of the fuel-infeed conduit.

10. The carburetor as defined in claim 8, wherein the fuel channel includes a starting section, an intermediate section and a terminal section which each have essentially the same diameter and which diameter is equal to the diameter of the lower fuel compartment.

11. The carburetor as defined in claim 8, wherein the fuel channel includes a starting section, an intermediate section and a terminal section each of which have a diameter which at most is 10% smaller than the diameter of the lower fuel compartment.

12. The carburetor as defined in claim 8, wherein there is provided a single nozzle.

13. The carburetor as defined in claim 8, further including two of said nozzles, and a respective fuel channel leading from the lower fuel compartment to each said nozzle.

14. The carburetor as defined in claim 13, wherein both nozzles are spaced at a different distance from the impeller wheel.

15. The carburetor as defined in claim 8, wherein the fuel channel possesses an intermediate section parallel to the axis of rotation of the fuel chamber-housing, the diameter of the intermediate section not exceeding the diameter of the lower fuel compartment and being greater than the diameter of the nozzle.

16. The carburetor as defined in claim 15, wherein the fuel channel further includes a terminal section which extends from the upper end of the intermediate section of the fuel channel to the nozzle, said terminal section being located in a plane which is essentially perpendicular to the axis of rotation of the fuel chamber-housing and having a diameter which is greater than the diameter of the nozzle.

17. The carburetor as defined in claim 15, wherein the fuel channel further includes a starting section extending from the lower fuel compartment to the intermediate section of the fuel channel, said starting section being located in a plane which is essentially perpendicular to the axis of rotation of the fuel chamber-housing and having a diameter which is not smaller than the diameter of the intermediate section of the fuel channel.

18. The carburetor as defined in claim 17, including a terminal section of the fuel channel which extends from the upper end of the intermediate section of the fuel channel to the nozzle, said terminal section being located in a plane which is essentially perpendicular to the axis of rotation of the fuel chamber-housing and having a diameter which is greater than the diameter of the nozzle, and wherein selectively at least the starting section, the terminal section, or both such sections of the fuel channel, extend in radial direction.

19. The carburetor as defined in claim 8, further including an atomizer device arranged in front of each nozzle in order to post-atomize the fuel which is delivered by at least one of the nozzles.

20. The carburetor as defined in claim 19, wherein the atomizer device comprises spray edge means rotating with the fuel chamber-housing.

21. The carburetor as defined in claim 19, wherein the fuel chamber-housing comprises a substantially cylindrical block possessing an axial blindhole bore for the reception of the fuel-infeed conduit and for forming the lower fuel compartment and bores for the fuel channel leading from the lower fuel compartment to the nozzle in a jacket surface of the cylindrical block.

22. The carburetor as defined in claim 19, wherein the fuel chamber-housing comprises a substantially cylindrical block, the atomizer device comprises ring means which at the region of each nozzle surrounds at a certain spacing the cylindrical housing block.

* * * * *